United States Patent [19]

Bernstein

[11] 4,116,434

[45] Sep. 26, 1978

[54] SIT-UP EXERCISE APPARATUS

[76] Inventor: Morton J. Bernstein, 3636 Graystone Ave., Bronx, N.Y. 10463

[21] Appl. No.: 777,638

[22] Filed: Mar. 15, 1977

[51] Int. Cl.[2] ..... A63B 23/02

[52] U.S. Cl. ..... 272/93; 272/900; D34/5 K

[58] Field of Search ..... 272/900, 145, 93, 116, 272/143, 109, 120, 144; D34/5 K, 96

[56] References Cited

U.S. PATENT DOCUMENTS

| | | | |
|---|---|---|---|
| D. 199,957 | 1/1965 | Bertoldo | D34/5 K |
| 680,556 | 8/1901 | Wieland | 272/136 |
| 2,050,652 | 8/1936 | Fleming | 272/900 |
| 2,253,758 | 8/1941 | Bulloch | 272/93 |
| 2,425,971 | 8/1947 | Walker | 272/144 |
| 3,077,613 | 2/1963 | Mayer | 272/900 X |
| 3,134,592 | 5/1964 | Sharkey | 272/900 X |
| 3,430,953 | 3/1969 | Teetor | 272/62 |
| 3,567,218 | 3/1971 | Johnson | 272/144 |
| 3,682,475 | 8/1972 | Walker | 272/145 |
| 3,850,430 | 11/1974 | Hamilton | 272/143 |

*Primary Examiner*—Richard J. Johnson
*Attorney, Agent, or Firm*—Leonard W. Suroff

[57] ABSTRACT

A sit-up exercise apparatus adapted to be utilized in conjunction with a door having spaced apart vertically extending surfaces and a bottom intermediate the surfaces. The apparatus comprises frame means having oppositely disposed sides and adapted to be removably secured to the door. The frame means includes an elongated base adapted to extend below the bottom of the door, and front and rear members, each one of the members having an oppositely disposed lower end connected to the base and an upper end with spaced apart inner and outer walls intermediate the ends. The inner walls adapted to extend in overlapping relation with the surfaces of the door. The inner walls oppositely disposed with respect to each other defining a space therebetween greater than the width of the door defined by the surfaces so as to readily permit the positionment of the door therebetween. Clamping means is operatively connected to one of the members and extends inwardly of the inner wall for releasably clamping one of the surfaces of the door, such that the frame is fixedly secured to the door at a selected position thereon and may be readily removed from securement therewith by releasing the clamping means. Supporting means extends outwardly from one of the members on the frame means and is adapted to extend at a height above the base so as to be readily engageable by the insteps of the user of the sit-up exercise apparatus.

33 Claims, 6 Drawing Figures

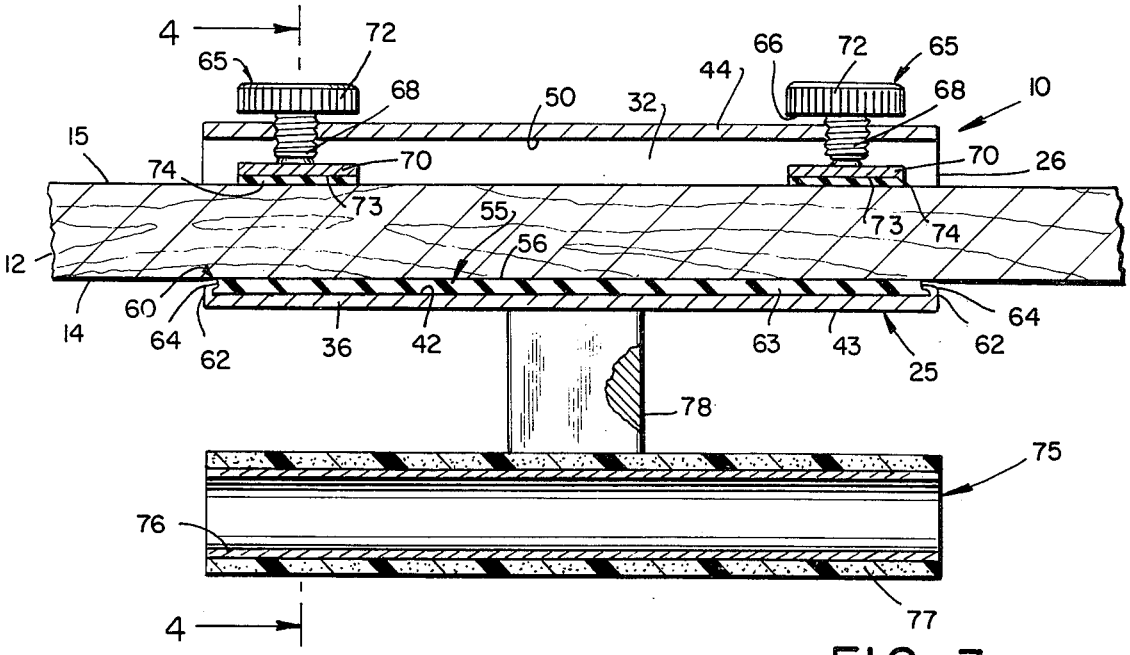
FIG. 3
FIG. 4
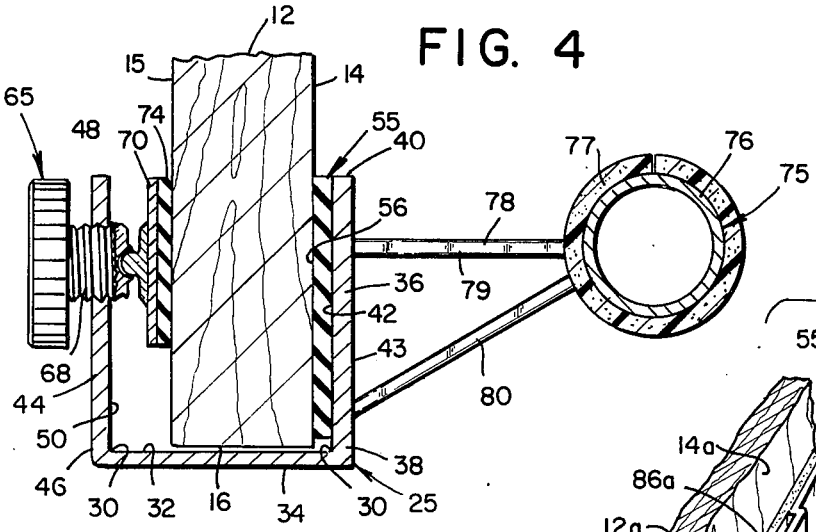
FIG. 5
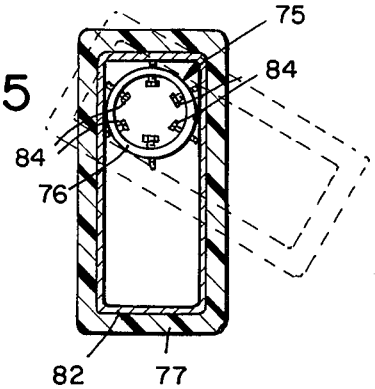
FIG. 6
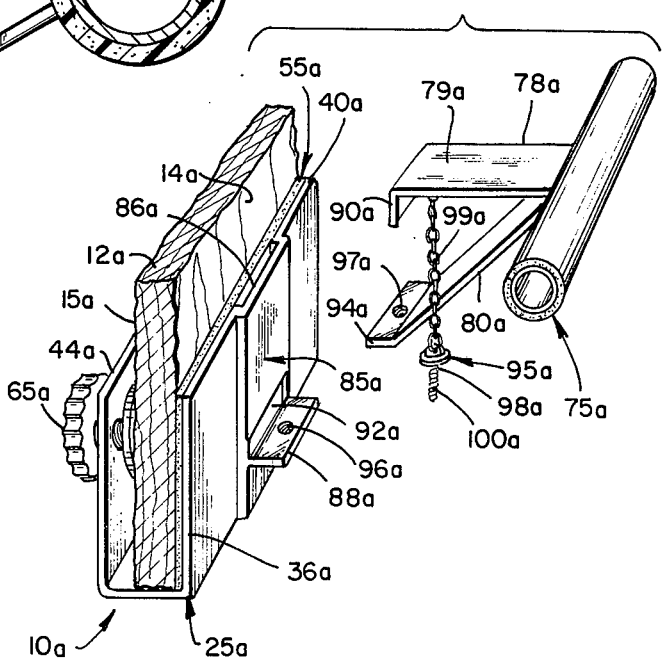

SIT-UP EXERCISE APPARATUS

BACKGROUND OF THE INVENTION

1. Field Of The Invention

The present invention relates to a sit-up exercise apparatus to facilitate the exercising of the abdominal muscles by male and female users thereof.

The need for exercise has become amply documented over the last decade, and a device to assist individuals in performing exercise at home is a most important implement in a exercise routine. The ability to perform sit-ups is a most important part of any exercise routine in physical conditioning.

2. Description Of The Prior Art

The prior art has appreciated the need to restrain the instep portion of the foot when performing a sit-up exercise to strengthen the abdominal muscles. As disclosed in U.S. Pat. No. 1,953,857 to Hunter, there is provided a device which is positioned on the floor and requires the user thereof to have his or her body extend thereacross. This provides a problem of storage as well as the need to purchase a support panel which is not necessary for performing the sit-up exercise.

An ideal solution to a sit-up exercise apparatus would be a device that is readily transportable, and one such device is disclosed in U.S. Pat. No. 2,050,652 to Fleming. Fleming utilizes a complicated structure for securement of the floor exercise device between the underside of a door and the floor.

I have discovered that it is possible to provide a sit-up exercise apparatus that is readily secured to a door without marring same and still permit certain adjustments to the portion of the apparatus against which the feet of the user are retained during the exercise. The advantages and distinctions of my invention over the prior art will become more clearly evident at the disclosure proceeds.

OBJECTS OF THE INVENTION

An object of the present invention is to provide a sit-up exercise apparatus that is adapted to be readily secured to a door and quickly released therefrom. Another object of the present invention is to provide a device for facilitating exercising of the abdominal muscles, that is of a rigid character and capable of being removably secured to a door.

Another object of the present invention is to provide a sit-up device which may be formed from metal having clamping means associated therewith for securement to the bottom of a door such that the user may lie in a flat position with the legs of the user retained in place by the device.

Another object of the present invention is to provide a sit-up exercising apparatus in which the portion thereof for engaging the instep of the person's feet is adjustable in height to accommodate users having different size feet.

Other objects and advantages of the present invention will become apparent as the disclosure proceeds.

SUMMARY OF THE INVENTION

A sit-up exercise apparatus adapted to be utilized in conjunction with a door having spaced apart vertically extending surfaces and a bottom intermediate the surfaces. The apparatus comprises frame means having oppositely disposed sides and adapted to be removably secured to the door, with the frame means comprising a base having spaced apart terminal ends extending in a plane substantially parallel to the surfaces of the door. The base is adapted to extend below the bottom of the door.

A front member is provided having an oppositely disposed lower end and an upper end and spaced apart inner and outer walls intermediate the ends. The lower end extends upwardly from the base along the terminal end, and the inner wall is adapted to extend in overlapping relation with one of the surfaces of the door.

A rear member is provided having an oppositely disposed lower end and an upper end and spaced apart inner and outer walls intermediate the ends. The lower end extending upwardly from the base along the terminal end, and the inner wall adapted to extend in overlapping relation with one of the surfaces of the door.

The inner walls are oppositely disposed with respect to each other defining a space therebetween greater than the width of the door defined by the surfaces so as to readily permit the positionment of the door therebetween. In this manner the frame extends below and on each side of the door.

Engaging means is secured to the inner wall of one of the members and has a contacting edge so as to provide a surface for engaging one of the surfaces of the door. Clamping means is operatively connected to the other one of the members and extends inwardly of the inner wall for releasably clamping the other one of the surfaces of the door, such that the frame is fixedly secured to the door at a selected position thereon and may be readily removed from securement therewith by releasing the clamping means.

Supporting means extends outwardly from one of the members on the frame and is adapted to extend at a height above the base so as to be readily engageable by the feet of the user of the sit-up apparatus. The supporting means comprises a support element extending in a plane substantially parallel to the member for engagement by the feet of the user of the sit-up apparatus, and a bracket extends between the support element and the member so as to rigidly retain the support element in fixed relationship to the frame means.

In accordance with one aspect of the invention, the sleeve is adapted to be angularly positioned on the support element so as to adjust the position thereof and vary the height for the user's feet to be gripped by the supporting means.

In accordance with another aspect of the invention, coupling means is provided for releasably securing the supporting means to the frame so as to permit the supporting means to be disassembled therefrom when the sit-up apparatus is not in use with the frame remaining assembled with the door.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 3 is a top plan view in section taken along lines 3—3 of FIG. 2;

FIG. 4 is a sectional view taken along lines 4—4 of FIG. 3;

FIG. 5 is a fragmentary view illustrating an adjustable supporting means in accordance with the present invention; and FIG. 6 is a perspective, exploded view, of another embodiment with removable supporting means.

DETAILED DESCRIPTION OF THE DRAWINGS

Figure 1:
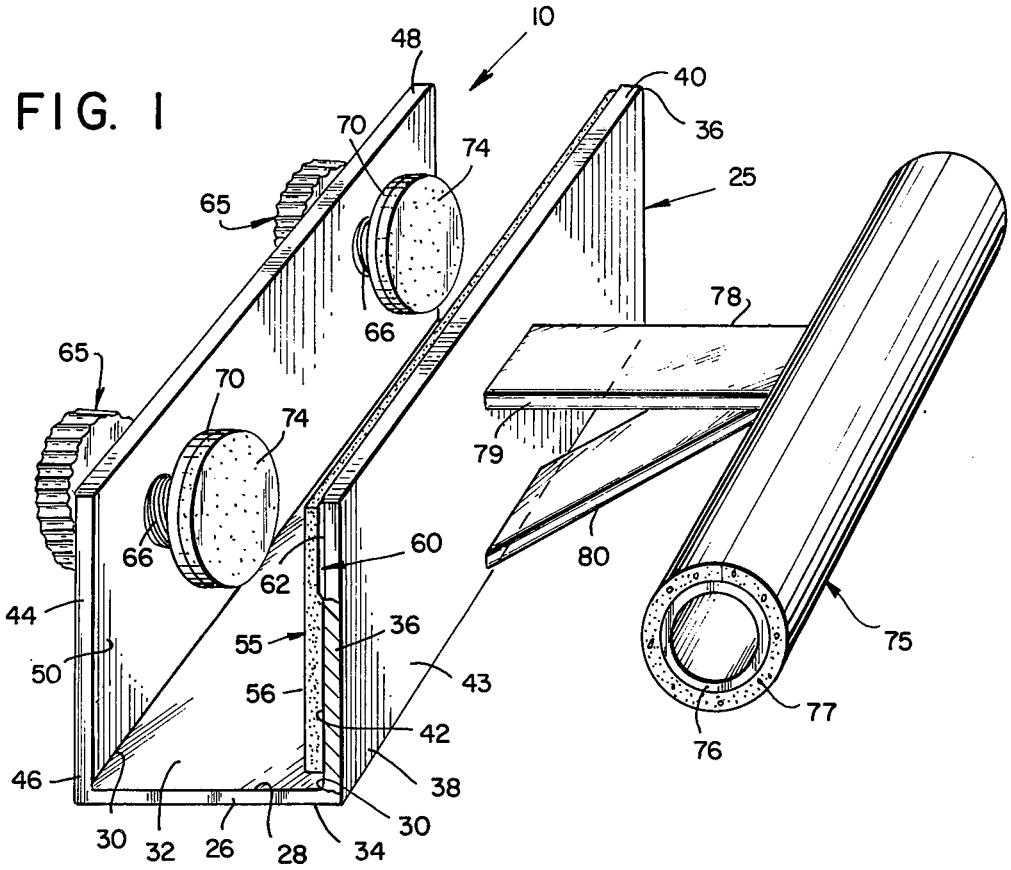
FIG. 1 is a perspective view of the sit-up exercise apparatus in accordance with the present invention.

Referring to the drawings, and initially to FIGS. 1-4, there is illustrated a sit-up exercise apparatus 10 adapted to be utilized in conjunction with a door 12 having spaced apart vertically extending surfaces 14 and 15 and a bottom or lower end 16 intermediate the surfaces 14 and 15. The user 18 of the apparatus 10 would situate his or her feet 20 in position by the instep portion 22, as hereinafter explained, while on the floor 24.

The apparatus 10 comprises frame means 25 having oppositely disposed sides 26 and adapted to be removably secured to the door 12. The frame means 25 comprises a base member 28 having spaced apart terminal ends 30 extending in a plane substantially parallel to the surface 14 and 15 of the door 12. The base 28, having an inner surface or wall 32 and outer surface or wall 34, is adapted to extend below the bottom 16 of the door 12. The frame means 25 is made of a rigid construction and may be fabricated from metal or plastic.

A front member 36 is provided having an oppositely disposed lower end 38 and an upper end 40 and spaced apart inner wall 42 and outer wall 43 intermediate the sides or ends 26. The lower end 38 extends upwardly from the base 28 along the terminal end 30, and the inner wall 42 is adapted to extend in overlapping relation with one of the surfaces 14 of the door 12.

A rear member 44 is provided having an oppositely disposed lower end 46 and an upper end 48 and spaced apart inner wall 50 and outer wall 52 intermediate the sides or ends 26. The lower end 46 extends upwardly from the base 28 along the terminal end 30, and the inner wall 50 is adapted to extend in overlapping relation with one of the surfaces 15 of the door 12.

The inner walls 42 and 50 are oppositely disposed with respect to each other defining a space therebetween greater than the width of the door defined by the surface 14 and 15 so as to readily permit the positionment of the door 12 therebetween. In this manner the frame means 25 extends below and on each side of the door 12. The inner walls 42 and 50 may extend in substantially parallel spaced relationship to each other, and the front member 36 and rear member 44 are integrally formed with the base 28.

Figure 2:
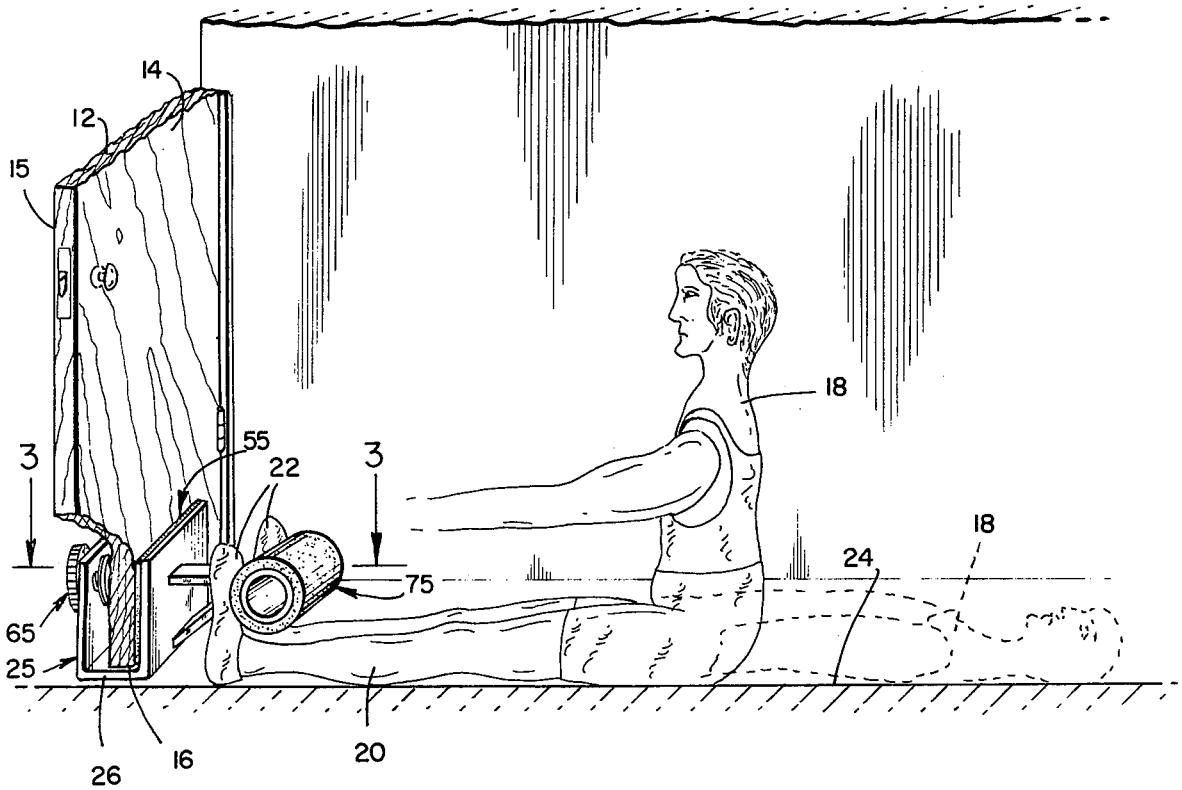
FIG. 2 is a perspective view, partially in section, illustrating the sit-up exercise apparatus of the present invention assembled with a door, or the like, and in use by a user doing sit-up exercises.

Accordingly, the frame means 25, as defined above, is readily placed in the position illustrated in FIG. 2 by initially opening the door 12 and sliding the frame means 25 into the desired position. Once in the position shown the frame means is releasably retained in place relative to the door 12 for the intended use of the sit-up apparatus 10.

The sit-up apparatus 10 includes engaging means 55 secured to the inner wall 42 of the front member 36. The engaging means 55 may be fabricated from a relatively soft material, such as rubber, having a contacting portion 56 so as to provide a surface for engagement with surface 14 of the door 12.

The engaging means 55 may include a complete sheet extending substantially across the full width of the front member 36. It may be secured to the inner wall 42 by an adhesive if so desired. As illustrated in FIGS. 1 and 3, there may be provided mounting means 60 utilized to retain the engaging means 55 in place. The mounting means 60 may include a pair of arms 62 extending substantially vertically along each of the sides 26 of the front member 36 and adapted to retain the engaging means 55 therebetween.

The respective arms 62 may be inclined inwardly towards each other and the engaging means which includes a resilient plate is provided with bevelled edges 64. The plate 63 is adapted to be removed from within the spaced apart arms 62. In this manner, if desired, the plate 63 may be replaced from time to time. The plate 63 has a forward or contacting edge or surface 56, with the arms 62 extending rearwardly of the contacting edge 56 of the engaging means 55.

Clamping means 64 is operatively connected to the rear member 44 and extends inwardly of the inner wall 50 for releasably clamping the surface 15 of the door 12, such that the frame means 25 is fixedly secured to the door at a selected position thereon and may be readily removed from securement therewith by releasing the clamping means 65.

The clamping means 65 comprises a pair of spaced apart locking elements 66, each one of the locking elements 66 being independently adjustable and comprises a threaded section 68 extending in threaded engagement through the rear member 44 with a shoe 70 at one end of the threaded section 66 for abutting engagement with the surface 15 of the door 12 and a handle 72 at the opposite end of the threaded section 68 so as to facilitate adjustment thereof.

Each shoe 70 is pivotally mounted with respect to the threaded section 66 so as to permit angular displacement relative thereto such that abutting engagement with the surface 15 of the door 12 may be obtained. The shoe 70 has a forward end 73, and the forward end 73 has a resilient portion 74 thereon to readily engage the surface 15 of the door 12 without marring same.

Supporting means 75 is provided and extends outwardly from the front member 36 on the frame means 25 and is adapted to extend at a height above the base 28 so as to be readily engageable by the feet 20 of the user 18 of the sit-up apparatus. The supporting means 75 comprises a support element 76, which may be tubular, extending in a plane substantially parallel to the front member 36 for engagement by the instep 22 of the user 18 of the sit-up apparatus 10. A bracket 78 extends between the support element 76 in fixed relationship to the frame means 25. A sleeve 77 may be provided on support element 76, and may be fabricated from a soft rubber or similar type material. The bracket 78 may include an upper rib 79 and lower rib 80.

In this manner the sit-up exercise apparatus 10 may be utilized with a variety of doors that may differ in thickness and even if the spaced surfaces 14 and 15 are not parallel to each other. The clamping means 65 permits the assembly 10 to be readily adjusted to a different size door. The word "door" as used herein further includes any other structure that would accomplish the same end purpose, i.e. a portion of a fence, etc. It will be appreciated that the assembly 10 is easily and quickly secured in place without the need of any tools. In this manner both a child or adult can easily assemble the apparatus 10, as well as disassemble same, with a door 12.

Referring to FIG. 5 of the drawings, there is illustrated a modification to the supporting means 75 in which the sleeve 77 is adapted to be angularly positioned on the support element 76 so as to permit adjustment of the position thereof. This adjustment permits the height and angle of contact with the instep 22 of the user 18 to be adjusted for comfort of the user 18.

To obtain this adjustment the sleeve 77 is mounted on a shell 82 which surrounds the support element 76. A plurality of locking screws 84 extend through the support element 76 for retention of the sleeve 77 in selective positions from vertical to inclined as illustrated in phantom.

Referring to FIG. 6 there is illustrated another form or embodiment of the invention in which the sit-up apparatus **10*a* is provided with coupling means 85*a* for releasably securing the supporting means 75*a* to the frame means 25*a* so as to permit the supporting means 75*a* to be disassembled therefrom when the sit-up apparatus 10*a* is not is use such that the frame means 25*a* may remain assembled with the door 12*a***.

This permits storage of the supporting means **75*a* when the assembly 10*a* is not is use. The coupling means 85*a* comprises a recess 86*a* provided on the front member 36*a* at substantially the upper end 40*a* thereof. A flange 88*a* extends outwardly from the outer wall 43*a* of the front member 36*a* in substantial vertical alignment with the recess 86*a*. A seat 92*a* is provided in the outer wall 43*a* of the front member 36*a* adjacent the flange 38*a***.

The bracket **78*a* has the upper rib 79*a* extending from the support element 76*a* and terminating in a downwardly extending lip 90*a*. The lip 90*a* is adapted to be received within the recess 86*a* in interlocking relationship therewith. The lower rib 80*a* terminates in a neck 94*a* which is adapted to extend in abutting engagement with the flange 88*a* and within the seat 92*a* so as to prevent vertical displacement between the flange 88*a* and the neck 94*a* when the supporting means 75*a*** is utilized.

To maintain the assembled relationship locking means **95*a* is provided and may include an aperture 96*a* in the flange 88*a* as well as an aperture 97*a* in the neck 94*a*. The apertures 96*a* and 97*a* being in alignment with each other when the bracket 78*a* is properly assembled with the front member 36*a*. A pin 98*a* is adapted to extend through the aligned apertures 96*a* and 97*a* to prevent lateral movement relative to each other. One end of the pin 98*a* is connected by chain 99*a* to the bracket 78*a*. The seat 92*a* is provided above the flange 88*a* but may also be provided below it. The ribs 79*a* and 80*a* are angularly displaced relative to each other to provide the required assembly with the front member 36*a*. Accordingly this embodiment provides the necessary compactness of the assembly 10*a*** both in shipment, storage and use thereof.

The lower end of the pin **98*a* may be provided with threads 100*a*, and the apertures 96*a* and 97*a*** may also both be threaded in order to obtain a secure coupling therebetween.

Although illustrative embodiments of the invention have been described in detail herein with reference to the accompanying drawings, it is to be understood that the invention is not limited to the precise embodiments, and that various changes and modifications may be effected therein without departing from the scope or spirit of the invention.

I claim:

1. A sit-up exercise apparatus adapted to be utilized in conjunction with a door having spaced apart vertically extending surfaces and a bottom intermediate said surfaces, said apparatus comprising:

A. frame means having oppositely disposed sides and adapted to be removably secured to the door, said frame means comprising:

(1) an elongated base adapted to extend below said bottom of the door, (2) front and rear members, each one of said members having an oppositely disposed lower end connected to said base and an upper end with spaced apart inner and outer walls intermediate said ends, said inner walls adapted to extend in overlapping relation with said surfaces of the door, and (3) said inner walls oppositely disposed with respect to each other defining a space therebetween greater than the width of the door defined by said surfaces so as to readily permit the positionment of the door therebetween, B. clamping means operatively connected to one of said members and extending inwardly of said inner wall for releasably clamping one of said surfaces of the door, such that said frame is fixedly secured to the door at a selected position thereon and may be readily removed from securement therewith by releasing said clamping means, C. said clamping means comprises a locking element being independently adjustable and having a threaded section extending in threaded engagement through one of said members with a shoe at one end of said threaded section for abutting engagement with said surface of the door and a handle at the opposite end of said threaded section so as to facilitate adjustment thereof, D. supporting means extending outwardly from one of said members on said frame means and adapted to extend at a height above said base so as to be readily engageable by the feet of the user of the sit-up exercise apparatus, E. coupling means for releasably securing said supporting means to said frame means so as to permit said supporting means to be dis-assembled therefrom when the sit-up apparatus is not in use such that said frame means may remain assembled with the door by means of said clamping means, F. said supporting means comprises:

(1) a support element having spaced apart free ends, and extending in a plane substantially parallel to said member for engagement by the insteps of the user of the sit-up apparatus, and (2) a bracket extending between said support element and said member intermediate said spaced apart free ends so as to rigidly retain said support element in fixed relationship to said frame means, said coupling means releasably securing said bracket to said frame means.

2. A sit-up apparatus as in claim 1, wherein said base is fabricated from a metallic material.

3. A sit-up apparatus as in claim 1, wherein said coupling means comprises:

a. a recess provided on one of said members at substantially said upper end thereof, and b. said bracket including an upper rib terminating in a downwardly extending lip, said lip adapted to be received within said recess in interlocking relationship therewith.

4. A sit-up apparatus as in claim 3, further including locking means to releasably secure said bracket within said recess.

5. A sit-up exercise apparatus adapted to be utilized in conjunction with a door having spaced apart vertically extending surfaces and a bottom intermediate said surfaces, said apparatus comprising A. frame means having oppositely disposed sides and adapted to be removably secured to the door, said frame means comprising (1) a base having spaced apart terminal ends extending in a plane substantially parallel to said surfaces of the door, said base adapted to extend below said bottom of the door, (2) a front member having an oppositely disposed lower end and an upper end and spaced apart inner and outer walls intermediate said ends, said lower end extending upwardly from said base along said terminal end, and said inner wall adapted to extend in overlapping relation with one of said surfaces of the door, (3) a rear member having an oppositely disposed lower end and an upper end and spaced apart inner and outer walls intermediate said ends, said lower end extending upwardly from said base along said terminal end, and said inner wall adapted to extend in overlapping relation with one of said surfaces of the door, (4) said inner walls oppositely disposed with respect to each other defining a space therebetween greater than the width of the door defined by said surfaces so as to readily permit the positionment of the door therebetween, B. resilient engaging means secured to said inner wall of one of said members, said engaging means having a contacting edge so as to provide a surface for engaging one of said surfaces of the door, C. clamping means operatively connected to the other one of said members and extending inwardly of said inner wall for releasably clamping the other one of said surfaces of the door, such that said frame is fixedly secured to the door at a selected position thereon and may be readily removed from securement therewith by releasing said clamping means, D. supporting means extending outwardly from one of said members of said frame means and adapted to extend at a height above said base so as to be readily engageable by the feet of the user of the sit-up exercise apparatus, E. coupling means for releasably securing said supporting means to said frame means so as to permit said supporting means to be dis-assembled therefrom when the sit-up apparatus is not in use such that frame means may remain assembled with the door by means of said clamping means, and F. said supporting means comprises:

(5) a support element having spaced apart free ends, and extending in a plane substantially parallel to said member for engagement by the insteps of the user of the sit-up apparatus, and (6) a bracket extending between said support element and said member intermediate said spaced apart free ends so as to rigidly retain said support element in fixed relationship to said frame means, said coupling means releasably securing said bracket to said frame means.

6. A sit-up apparatus as in claim 5, wherein said inner walls extend in substantially parallel spaced apart relationship to each other.

7. A sit-up apparatus as in claim 5, wherein said front member is integrally formed with said base.

8. A sit-up apparatus as in claim 5, wherein said rear member is integrally formed with said base.

9. A sit-up apparatus as in claim 5, wherein a. said engaging means and said supporting means are operatively connected to said front member, and b. said clamping means is operatively connected to said rear member.

10. A sit-up apparatus as in claim 5, further including mounting means on said member having said engaging means operatively associated therewith, said mounting means permitting said engaging means to be readily removable from assembled relation therewith.

11. A sit-up apparatus as in claim 10, wherein said mounting means comprising a pair of arms extending substantially vertically along each of said sides of said member and adapted to retain said engaging means therebetween.

12. A sit-up apparatus as in claim 11, wherein each of said arms includes a forward end adapted to extend rearwardly of said contacting edge of said engaging means.

13. A sit-up apparatus as in claim 12, wherein a. said engaging means includes a resilient plate having a pair of beveled ends, and b. said arms are inclined inwardly towards each other to enclose said beveled ends therebetween.

14. A sit-up apparatus as in claim 10, wherein said mounting means is provided on said front member.

15. A sit-up apparatus as in claim 5, wherein said clamping means comprises a locking element being independently adjustable having a threaded section extending in threaded engagement through one of said members with a shoe at one end of said threaded section for abutting engagement with said surface of the door and a handle at the opposite end of said threaded section so as to facilitate adjustment thereof.

16. A sit-up apparatus as in claim 15, wherein said shoe is pivotally mounted with respect to said threaded section so as to permit angular displacement relative thereto such that abutting engagement with said surface of the door may be obtained.

17. A sit-up apparatus as in claim 15, wherein said shoe has a forward end, and said forward end has a resilient portion thereon to readily engage said surface of the door without marring same.

18. A sit-up apparatus as in claim 5, wherein said base and said front and rear members are integrally formed with each other.

19. A sit-up apparatus as in claim 5, further including a sleeve on said support element.

20. A sit-up apparatus as in claim 19, wherein said sleeve is adapted to be angularly positioned on said support element so as to adjust the position thereof and vary the height for the user's feet to be gripped by said supporting means.

21. A sit-up apparatus as in claim 5, wherein said coupling means comprises:

a. a recess provided on one of said members at substantially said upper end thereof, and b. said bracket including an upper rib terminating in a downwardly extending lip, said lip adapted to be received within said recess in interlocking relationship therewith.

22. A sit-up apparatus as in claim 21, further including locking means to releasably secure said bracket within said recess.

23. A sit-up exercise apparatus adapted to be utilized in conjunction with a door having spaced apart vertically extending surfaces and a bottom intermediate said surfaces, said apparatus comprising:

A. frame means having oppositely disposed sides and adapted to be removably secured to the door, said frame means comprising:

(1) a base having spaced apart terminal ends extending in a plane substantially parallel to said surfaces of the door, said base adapted to extend below said bottom of the door, (2) a front member having an oppositely disposed lower end and an upper end and spaced apart inner and outer walls intermediate said ends, said lower end extending upwardly from said base along said terminal end, and said inner wall adapted to extend in overlapping relation with one of said surfaces of the door, (3) a rear member having an oppositely disposed lower end and an upper end and spaced apart inner and outer walls intermediate said ends, said lower end extending upwardly from said base along said terminal end, and said inner wall adapted to extend in overlapping relation with one of said surfaces of the door, (4) said inner walls oppositely disposed with respect to each other defining a space therebetween greater than the width of the door defined by said surfaces so as to readily permit the positionment of the door therebetween, B. engaging means secured to said inner wall of one of said members, said engaging means having a contacting edge so as to provide a surface for engaging one of said surfaces of the door, C. clamping means operatively connected to the other one of said members and extending inwardly of said inner wall for releasably clamping the other one of said surfaces of the door, such that said frame is fixedly secured to the door at a selected position thereon and may be readily removed from securement therewith by releasing said clamping means, D. supporting means extending outwardly from one of said members on said frame means and adapted to extend at a height above said base so as to be readily engageable by the feet of the user of the sit-up exercise apparatus, E. said supporting means comprises:

(5) a support element extending in a plane substantially parallel to said member for engagement by the feet of the user of the sit-up apparatus, and (6) a bracket extending between said support element and said member so as to rigidly retain said support element in fixed relationship to said frame means, F. including coupling means for releasably securing said supporting means to said frame means so as to permit said supporting means to be disassembled therefrom when the sit-up apparatus is not in use such that said frame means may remain assembled with the door, G. said coupling means comprises:

(7) a recess provided on said member at substantially said upper end thereof, (8) a flange extending outwardly from said outer wall of said member in substantial vertical alignment with said recess, (9) a seat in said outer wall of said member adjacent said flange,

(10) said bracket including an upper rib and a lower rib extending from said support element, said upper rib terminating in a downwardly extending lip, said lip adapted to be received within said recess in interlocking relationship therewith, and

(11) said lower rib terminating in a neck, said neck adapted to extend in abutting engagement with said flange and within said seat, so as to prevent vertical displacement between said flange and said neck when said supporting means is utilized, H. locking means to releasably secure said flange to said neck, and I. said locking means comprises:

(12) an aperture in said flange,

(13) an aperture in said neck, said apertures being in alignment with each other when said bracket is properly assembled with said member, and

(14) a pin adapted to extend through said aligned apertures to prevent lateral movement relative to each other.

24. a sit-up apparatus as in claim 23, wherein one end of said pin is chained to said bracket.

25. A sit-up apparatus as in claim 23, wherein said seat is provided above said flange.

26. A sit-up apparatus as in claim 23, wherein said ribs are angularly displaced relative to each other.

27. A sit-up exercise apparatus adapted to be utilized in conjunction with a door having spaced apart vertically extending surfaces and a bottom intermediate said surfaces, said apparatus comprising:

A. frame means having oppositely disposed sides and adapted to be removably secured to the door, said frame means comprising:

(1) an elongated base adapted to extend below said bottom of the door, (2) front and rear members, each one of said members having an oppositely disposed lower end connected to said base and an upper end with spaced apart inner and outer walls intermediate said ends, said inner walls adapted to extend in overlapping relation with said surfaces of the door, and (3) said inner walls oppositely disposed with respect to each other defining a space therebetween greater than the width of the door defined by said surfaces so as to readily permit the positionment of the door therebetween, B. clamping means operatively connected to one of said members and extending inwardly of said inner wall for releasably clamping one of said surfaces of the door, such that said frame is fixedly secured to the door at a selected position thereon and may be readily removed from securement therewith by releasing said clamping means, C. said clamping means comprises locking element being independently adjustable with a threaded sectin extending in threaded engagement through said member with a front end for abutting engagement with said surface of the door and a handle at the opposite end of said threaded section so as to facilitate adjustment thereof, D. supporting means extending outwardly from one of said members on said frame means and adapted to extend at a height above said base so as to be readily engageable by the feet of the user of the sit-up exercise apparatus, E. coupling means for releasably securing said supporting means to said frame means so as to permit said supporting means to be disassembled therefrom when the sit-up apparatus is not in use such that said frame means may remain assembled with the door by means of said clamping means, F. said supporting means comprises:

(1) a support element having spaced apart free ends, and extending in a plane substantially parallel to said member for engagement by the insteps of the user of the sit-up apparatus, and (2) a bracket extending between said support element and said member intermediate said spaced apart free ends so as to rigidly retain said support element in fixed relationship to said frame means, said coupling means releasably securing said bracket to said frame means, and G. locking means operatively associated with said coupling means to releasably secure said supporting means to said frame means.

28. A sit-up exercise apparatus as in claim 27, further including engaging means secured to said inner wall of one of said members, said engaging means having a contacting edge so as to provide a surface for engaging one of said surfaces of the door, said engaging means being on an opposite member relative to said clamping means.

29. A sit-up apparatus as in claim 27, wherein said coupling means comprises:

a. a recess provided on one of said members at substantially said upper end thereof, and b. said bracket including an upper rib terminating in a downwardly extending lip, said lip adapted to be received within said recess in interlocking relationship therewith.

30. A sit-up apparatus as in claim 29, wherein said locking means releasably secures said upper rib within said recess.

31. A sit-up exercise apparatus adapted to be utilized in conjunction with a door having spaced apart vertically extending surfaces and a bottom intermediate said surfaces, said apparatus comprising:

A. frame means having oppositely disposed sides and adapted to be removably secured to the door, said frame means comprising:

(1) an elongated base adapted to extend below said bottom of the door, (2) front and rear members, each one of said members having an oppositely disposed lower end connected to said base and an upper end with spaced apart inner and outer walls intermediate said ends, said inner walls adapted to extend in overlapping relation with said surfaces of the door, and (3) said inner walls oppositely disposed with respect to each other defining a space therebetween greater than the width of the door defined by said surfaces so as to readily permit the positionment of the door therebetween, B. clamping means operatively connected to one of said members and extending inwardly of said inner wall for releasably clamping one of said surfaces of the door, such that said frame is fixedly secured to the door at a selected position thereon and may be readily removed from securement therewith by releasing said clamping means, C. said clamping means comprises a locking element being independently adjustable with a threaded section extending in threaded engagement through said member with a front end for abutting engagement with said surface of the door and a handle at the opposite end of said threaded section so as to facilitate adjustment thereof, D. supporting means extending outwardly from one of said members on said frame means and adapted to extend at a height above said base so as to be readily engageable by the feet of the user of the sit-up exercise apparatus, E. said supporting means comprises:

(1) a support element extending in a plane substantially parallel to said member for engagement by the insteps of the user of the sit-up apparatus, and (2) a bracket extending between said support element and said member so as to rigidly retain said support element in fixed relationship to said frame means, F. coupling means for releasably securing said supporting means to said frame means so as to permit said supporting means to be disassembled therefrom when the sit-up apparatus is not in use such that said frame means may remain assembled with the door, and G. said coupling means comprises:

(1) a recess provided on said member at substantially said upper end thereof, (2) a flange extending outwardly from said outer wall of said member in substantial vertical alignment with said recess, (3) a seat in said outer wall of said member adjacent said flange, (4) said bracket including an upper rib and a lower rib extending from said support element, said upper rib terminating in a downwardly extending lip, said lip adapted to be received within said recess in interlocking relationship therewith, and (5) said lower rib terminating in a neck, said neck adapted to extend in abutting engagement with said flange and within said seat, so as to prevent vertical displacement between said flange and said neck when said supporting means is utilized.

32. A sit-up apparatus as in claim 31, further including locking means to releasably secure said flange to said neck.

33. A sit-up apparatus as in claim 32, wherein said locking means comprises:

a. an aperture in said flange, b. an aperture in said neck, said apertures being in alignment with each other when said bracket is properly assembled with said member, and c. a pin adapted to extend through said aligned apertures to prevent lateral movement relative to each other.

* * * * *